US005419442A

United States Patent [19]

Wright, Jr.

[11] Patent Number: 5,419,442

[45] Date of Patent: May 30, 1995

[54] SEPARATING DEVICE FOR DISCRIMINATING BETWEEN DEFECTIVE AND NONDEFECTIVE ARTICLES

[75] Inventor: James A. Wright, Jr., Trinity, N.C.

[73] Assignee: E. R. Squibb & Sons, Inc., Princeton, N.J.

[21] Appl. No.: 185,547

[22] Filed: Jan. 24, 1994

[51] Int. Cl.[6] ..... B07C 5/12

[52] U.S. Cl. ..... 209/682; 209/644; 209/920; 221/159; 221/171; 198/391

[58] Field of Search ..... 209/644, 660, 666, 680, 209/682, 696, 697, 920; 221/157, 159, 171, 173, 200; 198/390, 391

[56] References Cited

U.S. PATENT DOCUMENTS

| | | | |
|---|---|---|---|
| 1,460,270 | 6/1923 | Purchas | 209/680 X |
| 2,964,182 | 12/1960 | Spurlin | 209/682 X |
| 3,650,367 | 3/1972 | Mead | 198/391 X |
| 4,535,893 | 8/1985 | Buhren | 209/680 X |
| 4,635,798 | 1/1987 | Bruck | 209/644 |
| 4,709,798 | 12/1987 | Herzog | 209/644 X |

FOREIGN PATENT DOCUMENTS

| | | | |
|---|---|---|---|
| 1780864 | 12/1992 | U.S.S.R. | 209/680 |
| 3001006 | 1/1993 | WIPO | 209/680 |

*Primary Examiner*—David H. Bollinger
*Assistant Examiner*—Tuan N. Nguyen
*Attorney, Agent, or Firm*—Stuart E. Krieger

[57] ABSTRACT

The separation device includes a container having a dome-shaped base and a peripheral wall surrounding the base to define a chamber for receiving a random mixture of defective and nondefective articles. A spiral-shaped ramp on the peripheral wall which surrounds the chamber and overhangs the base, leads to an elevated outlet opening. A vibrating device vibrates the chamber to excite movement of the defective and nondefective articles along the base and onto and up the ramp toward the outlet opening. The container also includes trap openings in the base and ramp to eliminate defective articles from the chamber. Discriminating devices are provided on the ramp that cause defective material to fall from the ramp back onto the base of the chamber. Only the nondefective articles can move on the ramp past the trapping devices toward the outlet of the container for transfer to another processing station.

19 Claims, 3 Drawing Sheets

SEPARATING DEVICE FOR DISCRIMINATING BETWEEN DEFECTIVE AND NONDEFECTIVE ARTICLES

BACKGROUND OF THE INVENTION

This invention relates to a separating device which receives a batch of defective and nondefective articles, automatically separates the defective and nondefective articles and delivers the nondefective articles to a processing station for further operation.

The invention is particularly adapted for use with processing equipment that assembles known sponge-like, disk-shaped filter members to ostomy pouches. The known filter members are usually stamped or die cut in circular form from relatively large sheets of sponge-like filter material.

During the cutting of circular shaped filters from a filter sheet, there are also unusable cut portions of the sheet material that often becomes mixed with the cut out filters. The unusable cut portions are generally the sheet material that lies between cut out filters, either in the body of the sheet or at an edge portion of the sheet. In some instances the cut out filter structure is incomplete and thus unusable, as when the cutting die makes an offset double stroke or the cutting die is at an edge of the sheet. The unusable cut portions of filter material are typically of smaller size than the usable circular filters.

Consequently, a batch of filters from a filter cutting station usually includes not only the desired disk shaped filters but also a percentage of unusable cut-out material that is accumulated with the usable cut out filters.

Attachment of disk-shaped filters to a pouch to form an ostomy bag can be carried out in a known automatic filter attachment device. The filter attachment device receives the batch of usable filters and non-usable filter material and automatically positions a filter for automatic attachment to the ostomy bag. The filter attachment device generally operates in trouble-free fashion when a disk-shaped filter is positioned for attachment to a bag. However the attachment device is unable to discriminate between a usable disk-shaped filter and unusable non-circular filter material that is randomly mixed with the disk-shaped filters.

The unusable filter material, if attached to a pouch, will result in an unacceptable ostomy bag. Furthermore, the unusable filter material can cause a jam-up in the automatic filter attachment apparatus, requiring shut down of the apparatus and manual removal of the unusable filter material. Frequent jam-ups cause significant loss of operational time and necessitate substantially continuous monitoring of the automatic filter attachment apparatus.

It is thus desirable to provide a device for separating the unusable filter material (the defective article) from the disk-shaped filters (the nondefective article) before such filters are delivered to an automatic filter attachment device.

OBJECTS AND SUMMARY OF THE INVENTION

Among the several objects of the invention may be noted the provision of a novel separation device for separating defective articles from nondefective articles, a novel separation device for separating defective articles from nondefective articles by trapping the defective articles, a novel separation device for separating defective articles from nondefective articles by causing the defective articles to fall away from the nondefective articles, a novel separation device for separating defective articles from nondefective articles by diverting the defective articles from a predetermined path to a collection device such that only the nondefective articles are received by the collection device, and a novel method of separating defective articles from nondefective articles.

Other objects and features of the invention will be in part apparent and in part pointed out hereinafter.

In accordance with the present invention, the separation apparatus includes a vibrating bowl feeder device having a spiral-shaped ramp and a dome-shaped base portion. The spiral-shaped ramp elevates the filters and the defective material from the base of the bowl to an outlet for usable filters located at an upper end of the ramp.

Traps are formed in the base of the apparatus and in the ramp to trap and collect defective material. Since the defective material is generally of smaller dimension than the disk-shaped filters, the traps can be openings of smaller size than the disk-shaped filters. Thus the traps do not trap the disk-shaped filters.

A discriminating device is also provided along the ramp which causes the defective articles to fall from the ramp to the base of the bowl. The discriminating device includes an indented section of the ramp wherein a ramp surface of reduced size is formed as a support ledge for the filters. A support member spaced from a free edge of the indented ramp section defines a discriminator opening. The discriminator opening is of smaller width than the disk-shaped filter, enabling the disk-shaped filter to be supported over the discriminator opening. However, defective material can fall through the discriminator opening onto the base of the device.

The fallen defective material can move toward a trap opening in the base or ramp or again move on the ramp toward the outlet for usable filters. If a defective material segment is collected in a trap opening at the base of the ramp or on the base of the device, it falls into a collection bin and can no longer recirculate on the ramp.

The disk-shaped filters, by virtue of their size, elude the traps and discrimination openings and thus pass across such openings to stay on course to the outlet for usable filters at the upper end portion of the ramp. Under this arrangement, the outlet of the separation device receives only the nondefective disk members and enables the filter attachment device to avoid the jam-ups and the defective products previously attributable to defective filter pieces.

The invention also includes a method of separating the defective articles from nondefective articles by passing both the defective and nondefective articles across traps and discriminator means to collect the defective material or redirect it back onto a base portion of the device and away from the outlet of the device which receives only the nondefective articles.

The invention accordingly comprises the constructions and method hereinafter described, the scope of the invention being indicated in the claims.

DESCRIPTION OF THE DRAWINGS

In the accompanying drawings.

Corresponding reference characters indicate corresponding parts throughout the several views of the drawings.

DETAILED DESCRIPTION OF THE INVENTION

Figure 1:
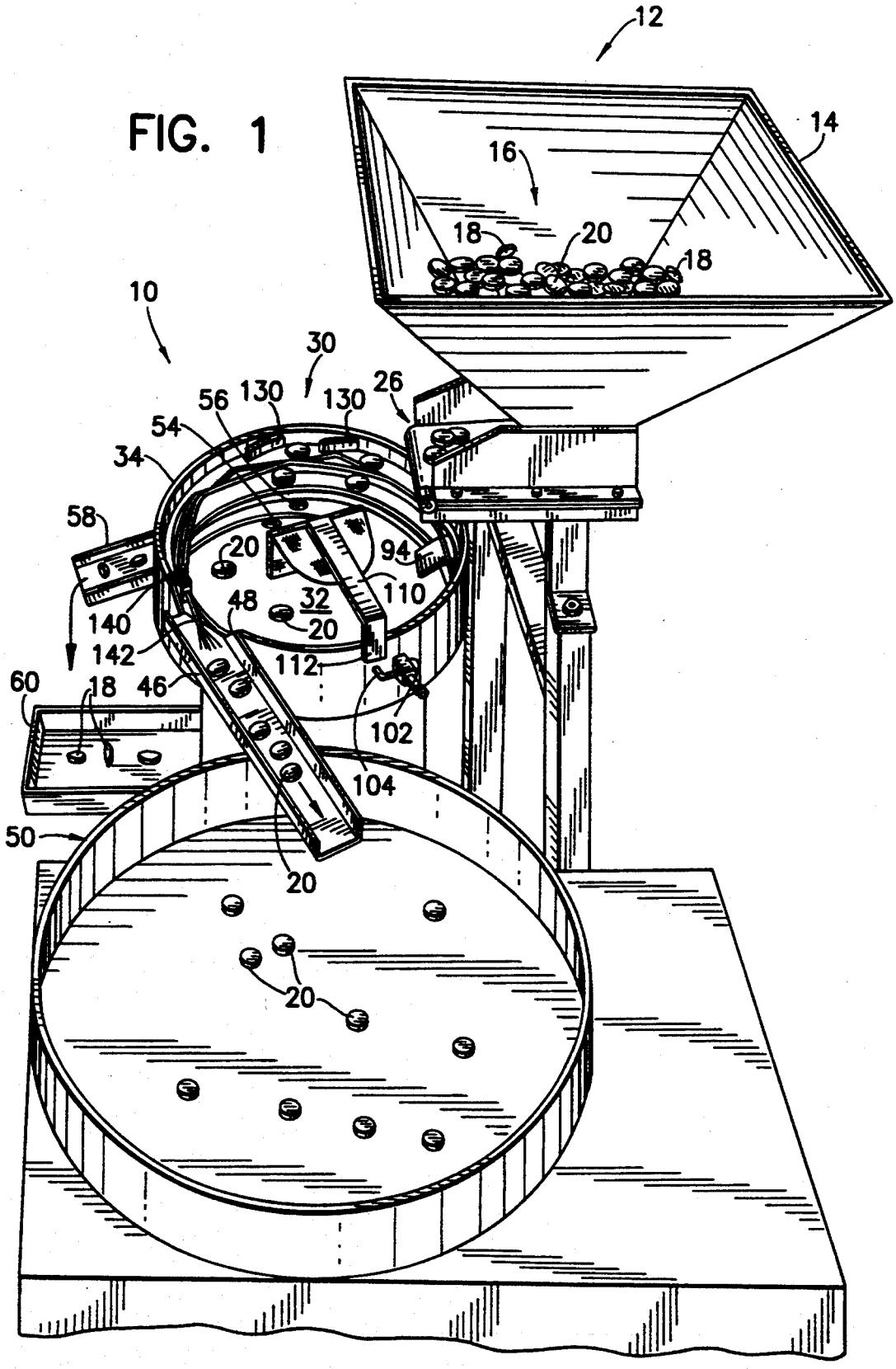
FIG. 1 is a perspective view of a system that includes the separating device incorporating one embodiment of the invention.

A processing system for attaching filters to ostomy bags incorporating the separating device of the invention is generally indicated by the reference number 10 in FIG. 1.

The system 10 has input means 12 that include a conventional hopper 14 which receives a batch of filter material 16. The batch of filter material 16 is a mixture of nondefective, usable, disk-shaped filters 20 having a diameter of approximately one inch for example, and defective, nonusable filter material indicated by the reference number 18. The defective, nonusable filter material 18 is noncircular or partially elliptical in shape and its largest or major dimension is generally less than the diameter of the disk 20.

The batch of material 16 drops from the hopper 14 onto a conventional conveyor 26 for delivery to a separation apparatus 30 that embodies the present invention.

The separation apparatus 30 incorporates a conventional vibrating bowl feeder device such as the Hoppman Bowl Feeder Assembly (Feeder Innovation Model No. E-100), which is modified to form the separating, discriminating and trapping functions as well as other functions which will be described. The apparatus 30 is in the form of a container having a dome-shaped base 32 surrounded by a peripheral wall 34 to define a receiving chamber 36 that receives the batch of material 16 from the conveyor 26.

A spiral-shaped ramp 40 extends around the chamber 36 along the peripheral wall 34 so as to overhang the base 32. The ramp 40 has a lower end portion 42 that merges with the base 32 at the peripheral wall 34, and an upper end portion 44 that communicates with an outlet slide 46 for usable filters. The outlet slide 46 communicates with the upper end portion 44 of the ramp 40 through a cutout opening 48 (FIG. 1) in the wall 34. The outlet slide 46 also communicates with a filter attachment apparatus shown schematically by the reference number 50.

A trap opening 54 is provided in the base 32 proximate the lower end portion 42 of the ramp 40. Another trap opening 56, similar to the trap opening 54, is provided in the ramp 40 also near the lower end 42 of the ramp 40. Both trap openings 54 and 56 communicate with a trash slide 58 provided at an underside of the base 32. The trash slide 58 leads to a trash collection bin 60. The diameter of the trap openings 54 and 56 is less than that of the disk 20 to ensure that the disks 20 do not fall into the trap openings 54 and 56.

A conventional air blower such as 62, can be provided on the wall 34 of the apparatus 30 at the base 32. The blower 62 includes a nozzle 63 directed along the interior surface of the wall 34 toward the lower end 42 of the ramp 40.

Figure 2:
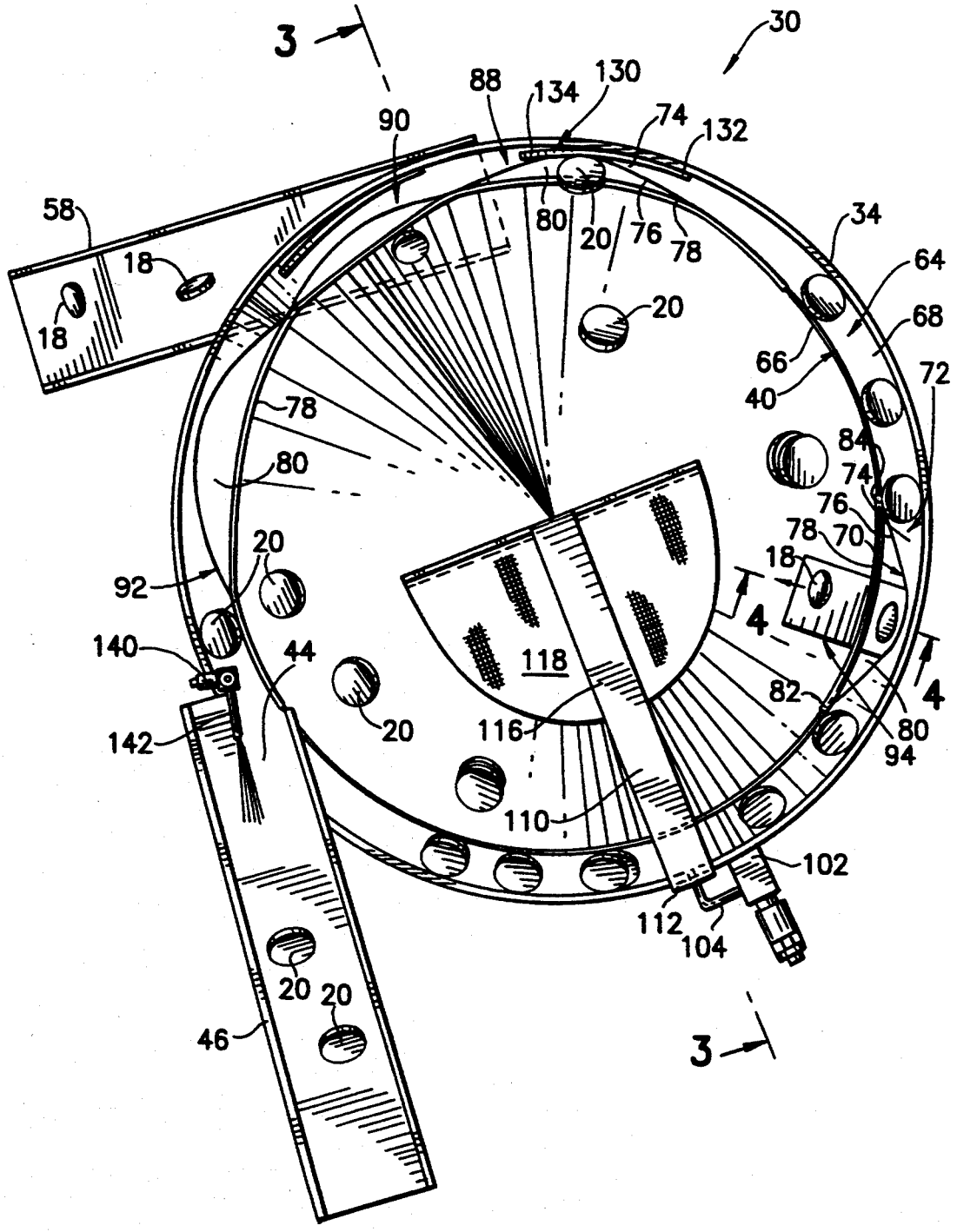
FIG. 2 is a top plan view of the separating device.
Figure 4:
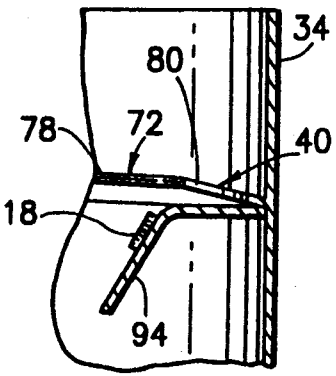
FIG. 4 is a fragmentary sectional view taken on the line 4—4 of FIG. 2.

As most clearly shown in FIG. 2, the ramp 40 has a ramp surface 64 with a normal free edge 66 having a predetermined radius of curvature about the center of the base 32. The ramp surface 64 also has a normal ramp width 68 between the normal free edge 66 and the peripheral wall 34 that is substantially equivalent to the diameter of the disk 20. The ramp surface 64 between the normal free edge 66 and the peripheral wall 34 is inclined slightly downwardly toward the base 32 such that the free edge 66 is at a higher elevation than a corresponding portion of the ramp surface at the wall 34. The angle of inclination is approximately 3°.

Discriminator means provided on the ramp to discriminate between the filter disks 20 and the nonusable filter material 18 include a curved indentation 70 (FIG. 2) formed in a section 72 of the ramp. The indentation 70 defines a reduced width ramp surface 74 at the section 72 that is less than the normal width 68 of the ramp surface 64 and has an indented free edge 76. It will be noted that the reduced width 74 of the ramp surface can vary since the indentation 70 is curved and can extend along a curved length of the ramp 40 that is approximately two to three times the diameter of the disk 20.

A support member 78 such as a stainless steel wire for example, spans the indented free edge 76 of the reduced width ramp section 74 such that a discriminator opening 80 is defined between the support member 78 and the indented free edge 76 of the ramp. The maximum width of the discriminator opening 80 from the support member 78 to the indented free edge 76 is less than the diameter of the filter member 20. The support member 78 is connected at opposite ends 82 and 84 to the normal free edge 66 of the ramp and has a curvature that is substantially the same radius of curvature as the normal free edge 66 of the ramp. Indented sections 88, 90 and 92 for example, are spaced from each other along the ramp and are generally similar to the indented section 72.

An L-shaped shield deflector 94 is provided below the indented section 72 for example. The deflector 94 shields the portion of the ramp 40 below the indented section 72 from any objects that fall through the discriminator opening 80. The deflector 94 is angled to direct objects such as the unusable filter material 18 onto the base 32.

Figure 3:
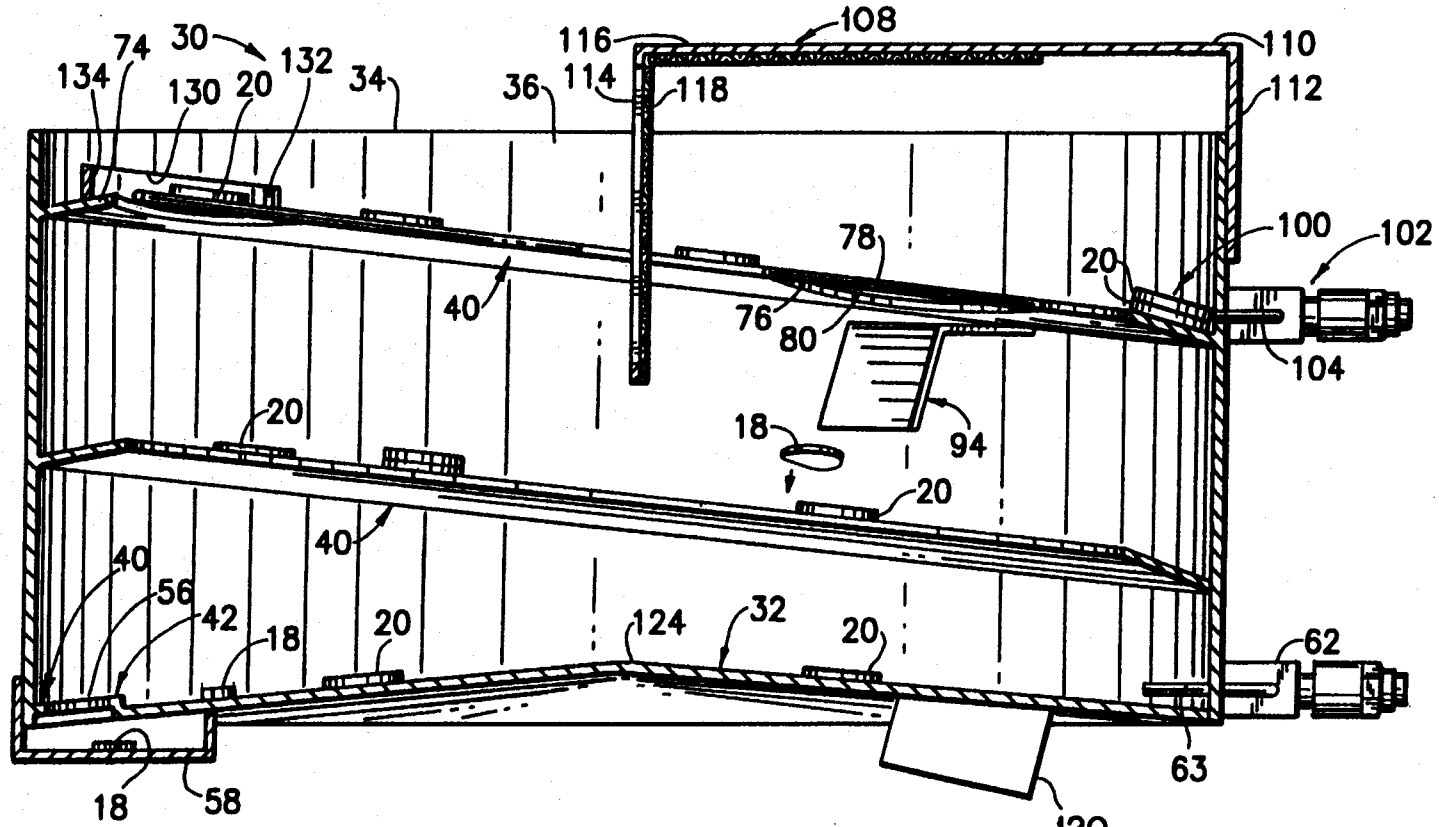
FIG. 3 is a sectional view taken on the line 3—3 of FIG. 2.

In some instances two or more filters 20 may become stacked as shown at the reference number 100 in FIG. 3. Since stacked filters 20 can cause assembly problems at the processing station 50, it is desirable to break up the stack 100 before the filters 20 are transferred to the processing station 50. An air blower 102 of known construction, similar to the blower 62, is thus provided on the wall 34 of the apparatus 30 and includes a nozzle or outlet tube 104. The outlet tube 104 is positioned at a predetermined level above the underlying filter 20 to direct a stream of air at the overlying filter 20 and thereby blow away any overlying filters 20 from an underlying filter 20. The underlying filter 20 remains in surface contact with the ramp surface 64. If desired, the nozzle 104 can be inclined at the same angle as the ramp surface 64. Additional air blower members 102 can be provided at spaced intervals along the ramp path.

A diffuser member 108 for diffusing the flow of air from the nozzle 104 includes a U-shaped bracket 110 having a leg 112 secured to the wall 34. An opposite leg 114 and a connection leg 116 support an L-shaped screen member 118. The screen member 118 is located in the path of air dispensed from the nozzle 104 to prevent the air flow from upsetting filter movement at the opposite side of the ramp 40. The diffuser member 108 also prevents a blown disk 20 from soaring across the apparatus 30 to an opposite wall portion.

A conventional vibrating device 120 (FIG. 3) provided at the base 32 or any other suitable location on the apparatus 30 operates to vibrate the entire apparatus 30 at a predetermined frequency. Thus the base 32, the wall portion 34 and the ramp 40 vibrate to excite movement of the batch of material 16 on the base 32 and on the ramp 40. The vibrator 120 is a component of the known Hoppman bowl feeder apparatus incorporated in this invention and characteristically causes elevational movement of the filter material 16 on the ramp 40 toward the outlet slide 46.

In using the apparatus 30, the batch of materials 16 is placed in the hopper 14. The hopper 14 dispenses portions of the batch of materials 16 onto the conveyor 26 which feeds the materials 16 at a predetermined rate into the apparatus 30. The batch of materials 16 are randomly received in scattered fashion on the base 32 of the apparatus 30. The vibrator 120 continuously operates to vibrate the entire apparatus 30. The vibration excites movement of the batch of materials 16 such that the filters 20 and the defective material 18 move radially outwardly from a peak-shaped central portion 124 of the base 32 toward the wall portion 34 and onto the ramp 40. The defective material 18 which passes across the trap opening 54 on the base 32 or across the trap opening 56 on the ramp 40, falls through the trap onto the trash slide 58 for collection in a trash bin 60 below the slide 58.

The filters or disks 20, which are larger than the trap openings 54 and 56, can move across such openings onto the ramp surface 64 at the lower end portion 42 of the ramp 40. If the defective material 18 bypasses the trap openings 54 and 56, it can move with the disks 20 along the ramp 40 elevating from the lower end 42 of the ramp 40 to the upper end portion 44.

When a disk 20 reaches an indented section 70 on the ramp 40, it is supported by the reduced width ramp surface 74 and by the support member 78, as shown most clearly in FIG. 2 at the indented section 88. The disk member 20 can thus traverse the indented section 88 and continue progressing toward the upper end portion 44 of the ramp toward the outlet slide 46.

A deflector baffle 130 has one end 132 joined to the wall portion 34 at the indentation section 70 and an opposite end 134 spaced from the wall portion 34 such that the baffle 130 is curved toward the discriminator opening 80. The reduced width ramp surface 74 at the indentation section 80 projects marginally beyond the deflector baffle to provide support for a filter 20 and also serves as a precipice from which the defective material 18 will fall through the discriminator opening 80.

The deflector baffle 130 thus operates to urge both the disk members 20 and the defective material 18 away from the wall portion 34 yet still provide some marginal support at the reduced width ramp surface 74 for the disk member 20. Under this arrangement, the defective material 18 can fall into the opening 80 whereas the filter member or disk member 20 will be supported over the opening 80 by the reduced width ramp surface 74 and the support member 78.

The deflector baffle 130 is not essential at all of the indented sections 72, 88, 90 and 92 because the reduced width ramp surface 74 may adequately serve as a precipice for some of the defective material 18 depending on the size of the material 18. Thus when the defective material 18 bypasses the trap openings 54 and 56 and moves along the ramp 40 to the indented sections 72, 88, 90 and 92, it will fall through the opening 80 between the support member 78 and the reduced edge 76 onto the base 32.

The fallen defective material 18 will then move again on the base 32 toward the wall portion 34 and the ramp 40 and may or may not fall into the trap openings 54 and 56. However, whether or not the defective material 18 falls into the trap openings 54 or 56, it is not able to reach the upper end portion 44 of the ramp or the outlet slide 46 because of the discriminator sections 72, 88, 90 and 92.

Under this arrangement, only the disk members 20 can pass to the next processing station 50 which does not receive any of the defective material 18. In this manner, the processing station 50 is enabled to operate in substantially continuous fashion without jam-ups caused by the defective material 18 and without inadvertently producing defective products caused by the defective material 18.

When a disk 20 reaches the upper end portion 44 of the ramp 40, it passes onto the outlet slide 46 which is downwardly inclined toward the processing station 50. A blower 140 similar to the blower 102, includes a nozzle 142 directed toward the slide 46 to accelerate movement of the disk members 20 into the processing station 50.

Some advantages of the invention evident from the foregoing description include a separation device that prevents defective material from reaching an outlet portion of the separation apparatus and ensures that only nondefective disk members reach the outlet portion. The apparatus is fully automatic and does not require movable parts other than the vibrator 120 and the air blowers 62, 102 and 130. Thus there is minimal maintenance needed for the separation apparatus.

In view of the above, it will be seen that the several objects of the invention are achieved and other advantageous results attained.

As various changes can be made in the above constructions and method without departing from the scope of the invention, it is intended that all matter contained in the above description or shown in the accompanying drawings shall be interpreted as illustrative and not in a limiting sense.

What is claimed is:

1. An apparatus for separating defective and nondefective articles comprising, a) a container having a base and a peripheral wall surrounding said base, to define a chamber for receiving a random mixture of defective and nondefective articles, b) said container including a first trap means for eliminating defective articles from said chamber, c) a spiral shaped ramp extending around said chamber along said peripheral wall so as to overhang said base, said ramp having one end portion proximate said base, said first trap means including an opening in said base in advance of said ramp, said opening being of predetermined size and shape to receive defective articles and the size and shape of said opening not permitting receipt of nondefective articles, d) said container having outlet means away from said base communicating with said ramp for receiving nondefective articles from said ramp, e) means for vibrating the container to excite movement of the random mixture of defective and nondefective articles from the base onto said ramp and toward said outlet means, f) means on said ramp for discriminating between defective and nondefective articles to prevent defective articles from moving on said ramp to said outlet means such that only nondefective articles pass from said ramp to said outlet means.

2. A method of separating defective and nondefective articles comprising, a) randomly depositing a mixture of defective and nondefective articles onto the base of a container, b) vibrating the container to excite movement of the articles in the container, c) directing movement of the articles along a path in the container that elevates the articles from the base of the container to an outlet of the container that is elevated from the base of the container, and d) separating the nondefective articles from the defective articles as they move along the elevation path to the outlet means by discriminating between the size of the defective and nondefective articles and withdrawing the defective articles from the path to the outlet means such that only the nondefective articles can pass to the outlet means of the container, such discrimination and withdrawal including:

(1) providing the path with a surface having a nominal width and at least one section having an indented free edge such that the width of said path at said one section is of reduced width less than said nominal width, (2) providing said one section with a support member that spans the indented free edge of said path, such that an opening is defined between said support member and the indented free edge of said path to receive defective articles in said opening, as they move along the path across the opening, (3) sizing said opening such that the nondefective articles cannot be received in said opening.

3. The method of claim 2 wherein the step of withdrawing includes causing the defective articles to fall from the elevation path before they reach the outlet means.

4. The method of claim 2 wherein the step of separating includes trapping the defective articles in a trap at the base portion of the container to prevent the defective articles from moving along the elevation path toward the outlet of the container.

5. An apparatus for separating defective and nondefective articles comprising, a) a container having a base and a peripheral wall surrounding said base, to define a chamber for receiving a random mixture of defective and nondefective articles, b) said container including a first trap means for eliminating defective articles from said chamber, c) a spiral shaped ramp extending around said chamber along said peripheral wall so as to overhang said base, said ramp having one end portion proximate said base, d) said container having outlet means communicating with said ramp for receiving nondefective articles from said ramp, and e) means on said ramp for discriminating between defective and nondefective articles to prevent defective articles from moving on said ramp to said outlet means such that only nondefective articles pass from said ramp to said outlet means, and wherein said ramp has a ramp surface with a normal free edge and a normal ramp width between the peripheral wall and the normal free edge, said discriminating means including at least one section of said ramp with an indented free edge such that the width of said ramp at said one section is of reduced width less than said normal width, said one section including a support member that spans the indented free edge of said ramp, said support member being substantially continuous with the normal free edge of said ramp such that an opening is defined between said support member and the indented free edge of said ramp to receive defective articles that fall from said one section into said opening.

6. The apparatus as claimed in claim 5 wherein said outlet means includes means for directing said nondefective articles to a predetermined location.

7. The apparatus as claimed in claim 6 wherein said directing means include a slide member upon which said nondefective articles slide to said predetermined location.

8. The apparatus as claimed in claim 5 wherein said outlet means is at a predetermined level from said base and said spiral shaped ramp is formed to define a path that elevates from said base to said predetermined level to communicate with said outlet means.

9. The apparatus as claimed in claim 5 further including means for exciting movement of said defective and nondefective articles on said base and up said ramp means from said base toward said outlet means.

10. The apparatus as claimed in claim 5 wherein said movement excitation means include vibrating means for vibrating said container at a predetermined frequency to excite said movement of said defective and nondefective articles.

11. The apparatus as claimed in claim 5 wherein said trap means includes an opening in said base proximate said ramp.

12. The apparatus as claimed in claim 5 wherein said trap means includes an opening in said ramp proximate said base.

13. The apparatus as claimed in claim 5 wherein said discriminator means includes an opening in said ramp.

14. The apparatus as claimed in claim 5 wherein said support member is a wire.

15. The apparatus as claimed in claim 14 wherein the normal free edge of said ramp has a predetermined radius of curvature and said wire has substantially the same radius of curvature as the normal free edge of said ramp.

16. The apparatus as claimed in claim 5 including a plurality of said one section spaced along said ramp.

17. The apparatus as claimed in claim 5 wherein said ramp surface between said normal free edge and said peripheral wall is inclined downwardly toward said base a predetermined amount such that a portion of said ramp surface at the peripheral wall is at a lower elevation than a corresponding portion of the ramp surface at the free edge.

18. The apparatus as claimed in claim 5 further including blower means disposed on said peripheral wall for directing an air current across said ramp at a predetermined height above said ramp surface to break up any stacks of nondefective articles on said ramp in front of said blower means.

19. The apparatus as claimed in claim 5 wherein said ramp has a base end portion and blower means are provided at said base along said wall for directing air current along the periphery of said wall at said base toward the base end of said ramp.

* * * * *